US008400249B2

(12) United States Patent
Kato

(10) Patent No.: US 8,400,249 B2
(45) Date of Patent: Mar. 19, 2013

(54) COMMON MODE CHOKE COIL AND HIGH-FREQUENCY COMPONENT

(75) Inventor: Noboru Kato, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/481,694

(22) Filed: May 25, 2012

(65) Prior Publication Data

US 2012/0306609 A1 Dec. 6, 2012

(30) Foreign Application Priority Data

May 31, 2011 (JP) ..... 2011-122540

Dec. 6, 2011 (JP) ..... 2011-266362

(51) Int. Cl.
*H01F 5/00* (2006.01)

(52) U.S. Cl. ..... 336/200

(58) Field of Classification Search ..... 336/65, 336/83, 200, 232
See application file for complete search history.

(56) References Cited

U.S. PATENT DOCUMENTS

| | | | | |
|---|---|---|---|---|
| 5,825,259 | A * | 10/1998 | Harpham | 333/22 R |
| 7,446,632 | B2 * | 11/2008 | Tomonari et al. | 333/185 |
| 7,508,292 | B2 * | 3/2009 | Nishikawa et al. | 336/200 |
| 7,646,280 | B2 * | 1/2010 | Ito et al. | 336/200 |

FOREIGN PATENT DOCUMENTS

| | | |
|---|---|---|
| JP | 2008-098625 A | 4/2008 |
| JP | 2009-065190 A | 3/2009 |
| JP | 2010-141642 A | 6/2010 |

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

A common mode choke coil includes a first coil element and a second coil element connected in series between a first port and a second port, and a third coil element and a fourth coil element connected in series between a third port and a fourth port. With normal mode current flow through the first and second transmission lines, a first closed magnetic circuit forms in which magnetic flux passing through the first and second coil elements forms a closed loop, and a second closed magnetic circuit forms in which a magnetic flux passing through the third coil element and the fourth coil element forms a closed loop. With common mode current flow in the first and second transmission lines, a third closed magnetic circuit forms in which a magnetic flux passing through the first through fourth coil elements forms a closed loop.

9 Claims, 6 Drawing Sheets

COMMON MODE CHOKE COIL AND HIGH-FREQUENCY COMPONENT

CROSS REFERENCE TO RELATED APPLICATIONS

The present application claims priority to Japanese Patent Application No. 2011-266362 filed on Dec. 6, 2011, and to Japanese Patent Application No. 2011-122540 filed on May 31, 2011, the entire contents of each of these applications being incorporated herein by reference in their entirety.

FIELD OF THE INVENTION

The present invention relates to a common mode choke coil used on a high-frequency signal transmission line and a high-frequency component including the common mode choke coil.

BACKGROUND

High-speed interfaces such as a Universal Serial Bus (USB) and a High-Definition Multimedia Interface (HDMI) transmit signals that are approximately 180° out of phase with each other through a balanced line with a differential transmission method. In the differential transmission method, since radiation noise components or exogenous noise components cancel each other, they have little effect on the transmission of signals. However, in a case where the superimposition of common mode noise occurs between the ground and a balanced line or common mode noise is generated because of the asymmetry of a balanced signal, unnecessary radiation (EMI/EMS) occurs.

In order to suppress such common mode noise, a common mode choke coil is generally disposed on a balanced line.

For example, as disclosed in Japanese Unexamined Patent Application Publication No. 2008-098625, a common mode choke coil has a structure in which two choke coils having the same winding direction are coupled. Accordingly, when a common mode current flows, magnetic fluxes generated by the two choke coils are combined in a magnetic core, a large mutual inductance is generated, and the common mode current is reduced. That is, when a common mode current flows through a balanced line on which a common mode choke coil is disposed, an induced voltage is generated at the two choke coils in the direction in which the common mode current is canceled. As a result the common mode current is reduced.

In order to enhance the effect of reducing a common mode current (common mode noise), it is necessary to increase the degree of coupling between choke coils. Accordingly, two choke coils in a common mode choke coil are generally included in a magnetic substance.

In a high-speed interface using a balanced line, in order to achieve a high-speed transmission signal, the structure of an IC itself tends to be vulnerable to Electro-Static Discharge (ESD). Accordingly, an ESD protection element is often used. As disclosed in, for example, Japanese Unexamined Patent Application Publication Nos. 2009-065190 and 2010-141642, a composite device obtained by integrating a common mode choke coil and an ESD protection element has been developed.

SUMMARY

The present disclosure provides a common mode choke coil and a high-frequency component including the common mode choke coil.

In one aspect of the disclosure, a common mode choke coil includes a first transmission line, a second transmission line paired with the first transmission line, a first coil element connected in series to the first transmission line, a second coil element connected in series to the first transmission line, a third coil element connected in series to the second transmission line and coupled to the first coil element, and a fourth coil element connected in series to the second transmission line and coupled to the second coil element. Winding directions and connection directions of the first coil element, the second coil element, the third coil element, and the fourth coil element are determined such that, with normal mode current flow through the first and second transmission lines, a first closed magnetic circuit forms in which a magnetic flux passing through the first coil element and the second coil element forms a closed loop and a second closed magnetic circuit forms in which a magnetic flux passing through the third coil element and the fourth coil element forms a closed loop, and, with common mode current flow through the first and second transmission lines, a third closed magnetic circuit forms in which a magnetic flux passing through the first coil element, the second coil element, the third coil element, and the fourth coil element forms a closed loop.

In another aspect of the disclosure, a high-frequency component includes a common mode choke coil, where the common mode choke coil includes a first transmission line, a second transmission line paired with the first transmission line, a first coil element connected in series to the first transmission line, a second coil element connected in series to the first transmission line, a third coil element connected in series to the second transmission line and coupled to the first coil element, and a fourth coil element connected in series to the second transmission line and coupled to the second coil element. Winding directions and connection directions of the first coil element, the second coil element, the third coil element, and the fourth coil element are determined such that, with normal mode current flow through the first and second transmission lines, a first closed magnetic circuit forms in which a magnetic flux passing through the first coil element and the second coil element forms a closed loop and a second closed magnetic circuit forms in which a magnetic flux passing through the third coil element and the fourth coil element forms a closed loop, and, with common mode current flow through the first and second transmission lines, a third closed magnetic circuit forms in which a magnetic flux passing through the first coil element, the second coil element, the third coil element, and the fourth coil element forms a closed loop.

Other features, elements, characteristics and advantages will become more apparent from the following detailed description of preferred embodiments with reference to the attached drawings.

DETAILED DESCRIPTION

The inventor realized that, since a typical magnetic substance has its frequency characteristic, an available frequency band is limited. In particular, the firing atmosphere of a ferrite magnetic ceramic material is limited (a ferrite magnetic ceramic material cannot be fired under a reducing atmosphere), and thus a usable conductive material is limited.

Further, when using an ESD protection element, since a relatively high voltage is applied to the ESD protection element, the composite device has a complicated structure in which the choke coil is formed at a magnetic substance portion and the ESD protection element is formed at an insulation portion, as disclosed in Japanese Unexamined Patent Application Publication Nos. 2009-065190 and 2010-141642.

Figure 1A:
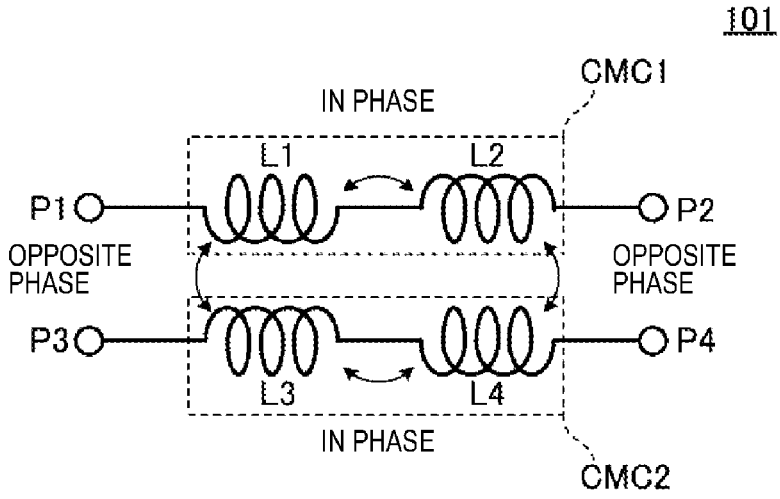
FIG. 1A is a circuit diagram of a common mode choke coil according to a first exemplary embodiment.

Exemplary embodiments of a common mode choke coil and a high frequency component including the common mode choke coil will now be described with reference to the figures. FIG. 1A is a circuit diagram of a common mode choke coil according to the first exemplary embodiment. A common mode choke coil 101 includes a first coil element L1 and a second coil element L2 which are connected in series between a first port P1 and a second port P2 and a third coil element L3 and a fourth coil element L4 which are connected in series between a third port P3 and a fourth port P4. The first port P1 and the second port P2 are connected in series to a first transmission line that is one of lines included in a balanced line. The third port P3 and the fourth port P4 are connected in series to a second transmission line that is the other one of the lines included in the balanced line. That is, the common mode choke coil 101 is interposed in series with the balanced line.

In the case of a normal mode (differential mode) signal, the opposite-phase coupling between the third coil element L3 and the first coil element L1, and the opposite-phase coupling between the fourth coil element L4 and the second coil element L2 are obtained. Furthermore, the in-phase coupling between the second coil element L2 and the first coil element L1 and the in-phase coupling between the fourth coil element L4 and the third coil element L3 are obtained.

Figure 1B:
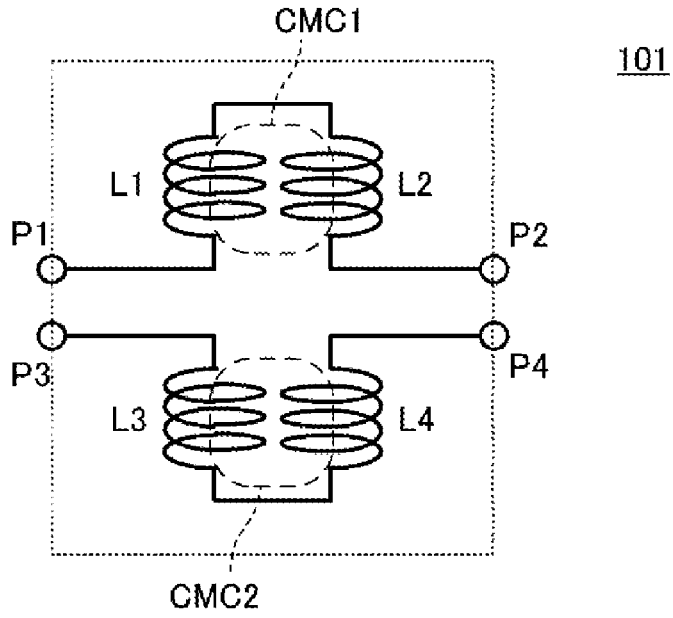
FIG. 1B is a diagram illustrating the coil winding axis and winding direction of each coil element included in the common mode choke coil according to the first exemplary embodiment.

FIG. 1B is a diagram illustrating the coil winding axis and winding direction of each coil element included in the common mode choke coil 101 according to the first exemplary embodiment. The first coil element L1 and the second coil element L2 are disposed adjacent to each other so that the winding axes of them are parallel to each other. The third coil element L3 and the fourth coil element L4 are disposed adjacent to each other so that the winding axes of them are parallel to each other.

When a normal mode current flows, a first closed magnetic circuit CMC1 in which a magnetic flux passing through the first coil element L1 and the second coil element L2 forms a closed loop is obtained and the first coil element L1 and the second coil element L2 are coupled to each other by magnetic field coupling. In addition, a second closed magnetic circuit CMC2 in which a magnetic flux passing through the third coil element L3 and the fourth coil element L4 forms a closed loop is obtained and the third coil element L3 and the fourth coil element L4 are coupled to each other by magnetic field coupling.

In the above-described coupling state in the normal mode, a closed-loop magnetic flux passing through the first closed magnetic circuit CMC1 formed by the first coil element L1 and the second coil element L2 and a closed-loop magnetic flux passing through the second closed magnetic circuit CMC2 formed by the third coil element L3 and the fourth coil element L4 repel each other. Accordingly, an equivalent magnetic barrier is generated between the first closed magnetic circuit CMC1 and the second closed magnetic circuit CMC2. The closed magnetic circuits and the magnetic barrier will be described later.

The first coil element L1 and the second coil element L2 are coupled mainly by magnetic field coupling, but may be coupled by electric field coupling when they are closely disposed. The third coil element L3 and the fourth coil element L4 are coupled mainly by magnetic field coupling, but may be coupled by electric field coupling when they are closely disposed.

Figure 2A:
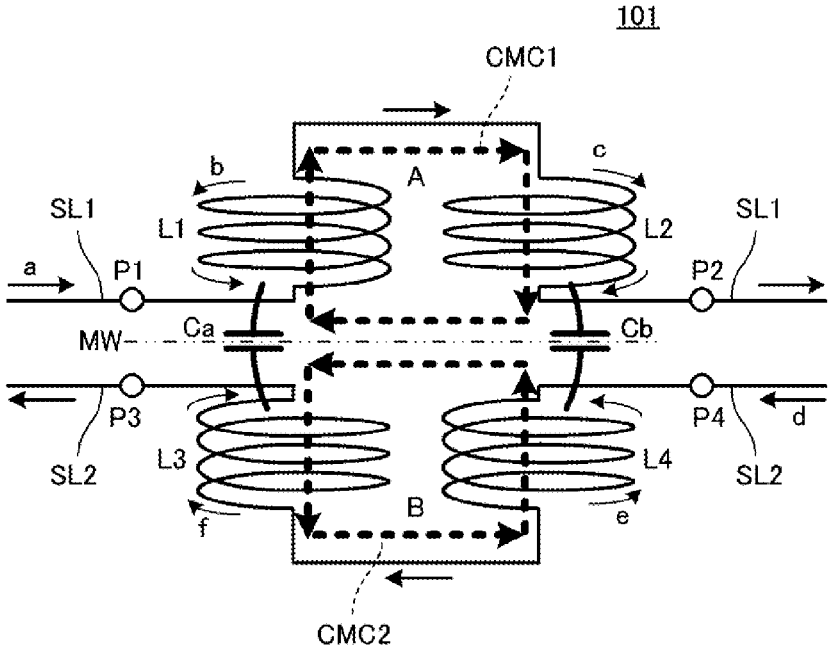
FIG. 2A is a diagram illustrating the coupling between coil elements included in the common mode choke coil according to the first exemplary embodiment when a normal mode current flows.
Figure 2B:
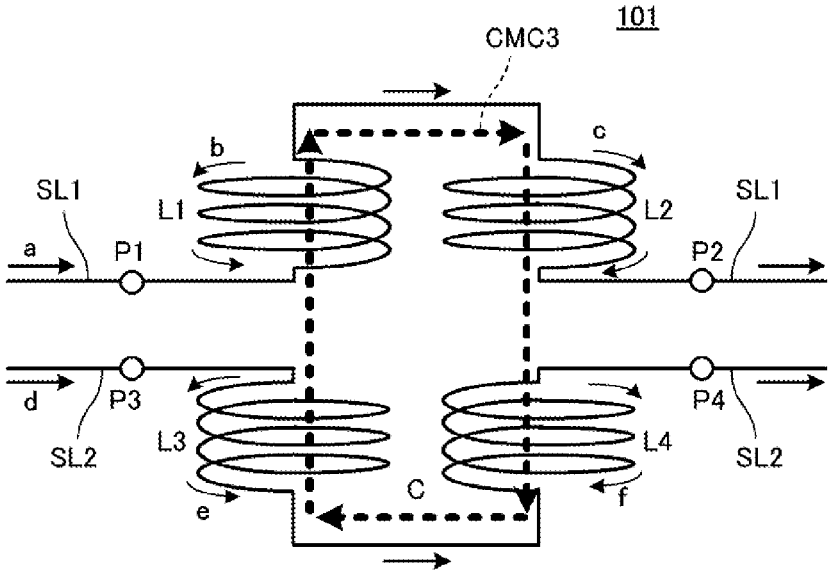
FIG. 2B is a diagram illustrating the coupling between coil elements included in the common mode choke coil according to the first exemplary embodiment when a common mode current flows.

FIG. 2A is a diagram illustrating the coupling between coil elements included in the common mode choke coil 101 when a normal mode current flows. FIG. 2B is a diagram illustrating the coupling between coil elements included in the common mode choke coil 101 when a common mode current flows. The first coil element L1 and the third coil element L3 are disposed adjacent to each other in a direction of the same winding axis shared by them (they are in line with each other). The second coil element L2 and the fourth coil element L4 are disposed adjacent to each other in a direction of the same winding axis shared by them (they are in line with each other).

When a normal mode current flows, the first closed magnetic circuit CMC1 in which a magnetic flux passing through the first coil element L1 and the second coil element L2 forms a closed loop is obtained and the second closed magnetic circuit CMC2 in which a magnetic flux passing through the third coil element L3 and the fourth coil element L4 forms a closed loop is obtained.

When a common mode current flows, a third closed magnetic circuit CMC3 in which a magnetic flux passing through the first coil element L1, the second coil element L2, the third coil element L3, and the fourth coil element L4 forms a closed loop is obtained.

In more detail, when a normal mode current flows through the first transmission line SL1 in a direction represented by an arrow a in FIG. 2A, the current flows through the first coil element L1 in a direction represented by an arrow b in FIG. 2A and flows through the second coil element L2 in a direction represented by an arrow c in FIG. 2A. This flow of the current forms the closed loop of a magnetic flux (a magnetic flux passing through the first closed magnetic circuit CMC1) represented by an arrow A in FIG. 2A. The current further flows through a second transmission line SL2 in a direction represented by an arrow d in FIG. 2A, flows through the fourth coil element L4 in a direction represented by an arrow e in FIG. 2A, and flows through the third coil element L3 in a direction represented by an arrow f in FIG. 2A. This flow of the current forms the closed loop of a magnetic flux (a magnetic flux passing through the second closed magnetic circuit CMC2) represented by an arrow B in FIG. 2A.

Thus, when the normal mode current flows, a closed-loop magnetic flux passing through the first closed magnetic circuit CMC1 and a closed-loop magnetic flux passing through the second closed magnetic circuit CMC2 repel each other. Accordingly, an equivalent magnetic barrier MW is generated between the first closed magnetic circuit CMC1 and the second closed magnetic circuit CMC2. That is, the first coil element L1 and the third coil element L3 are not coupled to each other, and the second coil element L2 and the fourth coil element L4 are not coupled to each other.

Since the coil elements L1 and L3 are closely disposed, a capacitor Ca illustrated in FIG. 2A is formed. Since the coil elements L2 and L4 are closely disposed, a capacitor Cb illustrated in FIG. 2A is formed. The characteristic impedances of the transmission lines SL1 and S12 in the normal mode can be determined in accordance with the capacitances of the capacitors Ca and Cb and the inductances of the closed magnetic circuits CMC1 and CMC2. For example, the differential characteristic impedance of a Universal Serial Bus (USB) in the normal mode is usually approximately 100 Ω.

When a common mode current flows through the first transmission line SL1 in a direction represented by an arrow a in FIG. 2B, the current flows through the first coil element L1 in a direction represented by an arrow b in FIG. 2B and flows through the second coil element L2 in a direction represented by an arrow c in FIG. 2B. The current further flows through the second transmission line SL2 in a direction represented by an arrow d in FIG. 2B, flows through the third coil element L3 in a direction represented by an arrow e in FIG. 2B, and flows through the fourth coil element L4 in a direction represented by an arrow f in FIG. 2B. This flow of the common mode current forms the closed loop of a magnetic flux (a magnetic flux passing through the third closed magnetic circuit CMC3) represented by an arrow C in FIG. 2B.

Thus, when the common mode current flows, a single closed magnetic circuit, i.e., the third closed magnetic circuit CMC3, is formed. Accordingly, the first coil element L1, the second coil element L2, the third coil element L3, and the fourth coil element L4 are magnetically coupled (magnetic fluxes passing through the third closed magnetic circuit CMC3 are added) and an impedance (inductance) is generated by the first coil element L1, the second coil element L2, the third coil element L3, and the fourth coil element L4. The common mode current is therefore reflected by the common mode choke coil 101 and does not pass through the common mode choke coil 101. That is, common mode noise is suppressed. In addition, since the common mode current forms a magnetic flux in the third closed magnetic circuit CMC3, no common mode noise is emitted into the air.

Figure 3:
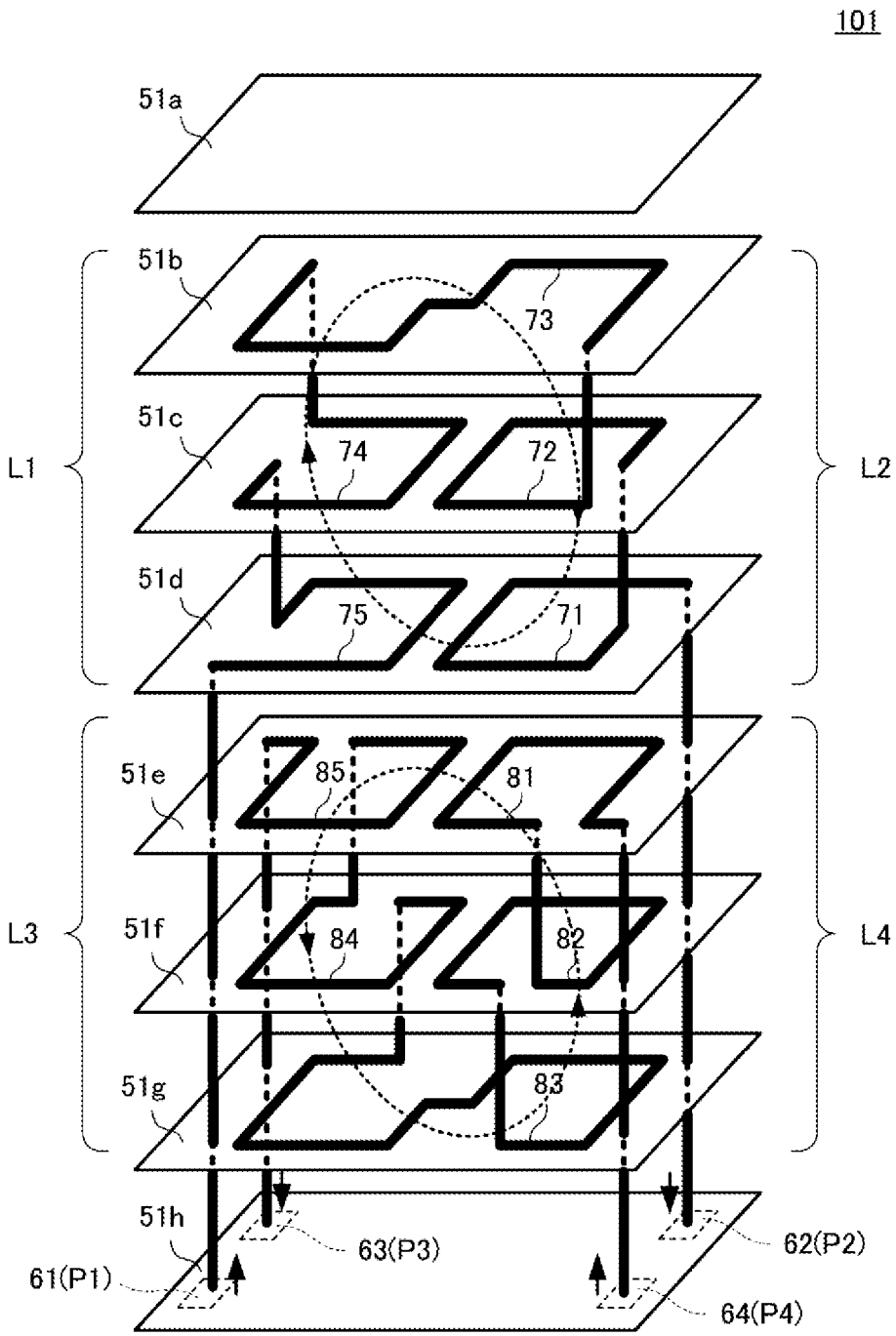
FIG. 3 is an exploded perspective view of the common mode choke coil according to the first exemplary embodiment.

FIG. 3 is an exploded perspective view of the common mode choke coil 101 according to the first exemplary embodiment.

As illustrated in FIG. 3, conductive patterns are formed at base substrate layers 51*b* to 51*h*. At the base substrate layer 51*b*, a conductive pattern 73 is formed. At the base substrate layer 51*c*, conductive patterns 72 and 74 are formed. At the base substrate layer 51*d*, conductive patterns 71 and 75 are formed. At the base substrate layer 51*e*, conductive patterns 81 and 85 are formed. At the base substrate layer 51*f*, conductive patterns 82 and 84 are formed. At the base substrate layer 51*g*, a conductive pattern 83 is formed. On the undersurface of the base substrate layer 51*h*, terminals 61, 62, 63, and 64, which correspond to ports P1, P2, P3, and P4, respectively, are formed. Each line extending in the vertical direction in FIG. 3 is a via electrode, or via hole conductor, and connects conductive patterns via layers.

Referring to FIG. 3, the conductive pattern 71 to 75 form the coil elements L1 and L2, and the conductive patterns 81 to 85 form the coil elements L3 and L4.

As a material for the base substrate layers in a case where a common mode choke coil used in the HF band is formed, a magnetic material (i.e., a high-permeability dielectric material) having a relatively small eddy current loss can be used from the viewpoint of magnetic energy trapping. On the other hand, as a material for the base substrate layers in a case where a common mode choke coil used in frequency bands higher than the UHF band is formed, it is desired that a dielectric material having a high insulation resistance be used so as to reduce an eddy current loss in a high-frequency range. According to an exemplary embodiment, since a closed magnetic circuit formed by a plurality of coil elements is used as described previously, a choke coil having a small frequency characteristic can be obtained not with a magnetic base substrate but with a dielectric body.

In a preferred embodiment, as a dielectric base substrate layer, a ceramic dielectric layer can be used, such as low temperature co-fired ceramic (LTCC) dielectric layer having a small loss in high-frequency bands. However, other embodiments can use a dielectric layer made of a resin, such as a thermosetting resin or a thermoplastic resin. As a magnetic substance, a ferrite ceramic material or a resin material containing ferrite can be used.

In a preferred embodiment, each coil element, a line connecting coil elements, and a line connecting a coil element and an external terminal can be made of a metallic material such as copper or silver having low resistivity.

Between a group of the conductive patterns 71 to 75 forming the first coil element L1 and the second coil element L2 and a group of the conductive patterns 81 to 85 forming the third coil element L3 and the fourth coil element L4, a magnetic layer may be formed. In this case, it is possible to increase the degree of magnetic coupling between the first coil element L1 and the third coil element L3 and the degree of magnetic coupling between the second coil element L2 and the fourth coil element L4 without increasing an eddy current loss when a common mode current component flows.

As illustrated in FIG. 3, the first coil element L1 and the third coil element L3 are disposed so that they share the same coil winding axis. That is, the coil winding axes of the coils L1 and L3 are on, or are substantially on the same straight line and are in coaxial relation with one another. The second coil element L2 and the fourth coil element L4 are disposed so that they share the same winding axis. That is, the coil winding axes of the coils L2 and L4 are on the same straight line and are in coaxial relation with one another. As can be seen, each conductive pattern can be formed at a corresponding base substrate layer so that the coil winding axes are perpendicular to the main surface of a laminate.

The first coil element L1 and the second coil element L2 are preferably disposed adjacent to each other so that the winding axes of the coils are substantially parallel to each other. The third coil element L3 and the fourth coil element L4 are preferably disposed adjacent to each other so that the winding axes of them are substantially parallel to each other. When each coil element is disposed as above, a closed magnetic circuit with less leakage magnetic field can be formed at each of the first transmission line and the second transmission line.

As illustrated in FIG. 3, in the normal mode, the direction of a current flowing through the first coil element L1 and the second coil element L2 is opposite to that of a current flowing through the third coil element L3 and the fourth coil element L4, so that a magnetic barrier is formed. That is, a magnetic field generated by a current flowing through the first coil element L1 and the second coil element L2, and a magnetic field generated by a current flowing through the third coil element L3 and the fourth coil element L4 are not added. In the normal mode, both of an inductance generated by the first coil element L1 and the second coil element L2 and an inductance generated by the third coil element L3 and the fourth coil element L4 are therefore small.

On the other hand, in the case of common mode noise, a magnetic field generated by a current flowing through the first coil element L1 and the second coil element L2 and a magnetic field generated by a current flowing through the third coil element L3 and the fourth coil element L4 are added. The magnetic field coupling generates a single closed magnetic circuit, and a large inductance value is generated by the coil elements L1, L2, L3, and L4. With this large inductance, a common mode component is reduced (reflected). No common mode noise is externally emitted from the closed magnetic circuit as a magnetic field. Accordingly, even in a case where high-frequency common mode noise (for example common mode noise in the UHF band) flows, the noise is not emitted from a common mode choke coil.

According to an exemplary embodiment, two coil elements connected in series to each other are provided at each of the first transmission line and the second transmission line. These coil elements do not form a single closed magnetic circuit when a normal mode signal flows, and forms a single closed magnetic circuit in the case of common mode noise. With the effect of the generation of the closed magnetic circuit, a thin coil having a large inductance value and a small loss can be obtained. It is therefore possible to reduce the size and thickness of a common mode choke coil, minimize the loss and radiation noise of the common mode choke coil, and increase the degree of coupling between transmission lines. That is, a common mode choke coil with a high common mode noise removal effect can be obtained. By adjusting the resonant frequency of each closed magnetic circuit, the wider frequency band of a common mode choke coil can be easily achieved.

A common mode choke coil according to an exemplary embodiment can be used in a high-speed interface such as an interface compliant with USB 2.0, USB 3.0, or an HDMI. Furthermore, a common mode choke coil according to an exemplary embodiment is suitable for use in a power supply circuit having a high switching frequency (for example approximately 1 MHz or higher) or a high-speed BUS line (having the transfer rate of, for example, approximately 600 MBit/sec or approximately 5 GBit/sec).

In the second exemplary embodiment, a high-frequency component according to an example will now be described.

Figure 4:
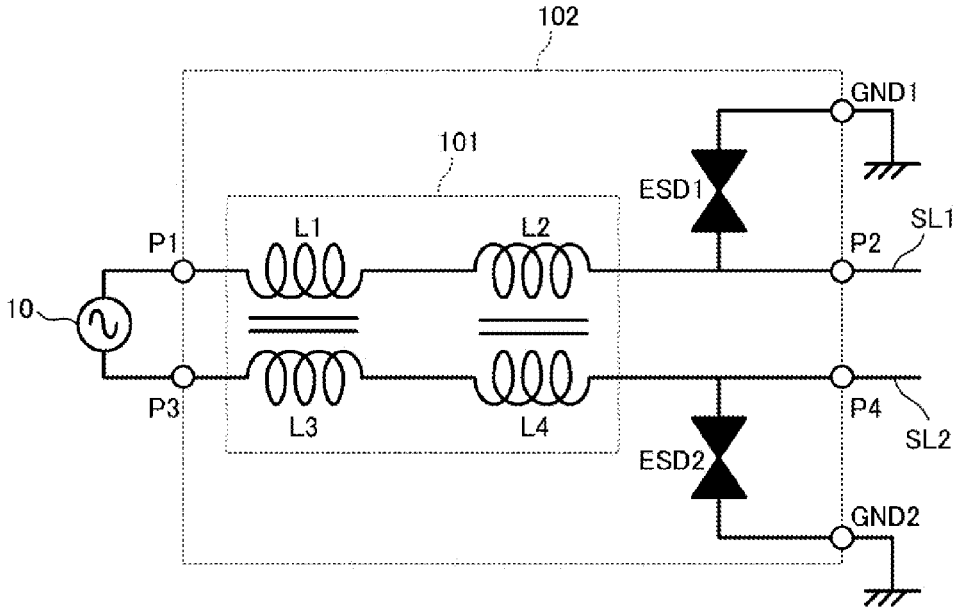
FIG. 4 is a circuit diagram of a common mode choke coil according to a second exemplary embodiment having an ESD protection function.

FIG. 4 is a circuit diagram of a common mode choke coil 102 according to the second exemplary embodiment, which has an ESD protection function. The common mode choke coil 102 with an ESD protection function includes the common mode choke coil 101 and ESD protection elements ESD1 and ESD2.

The configuration of the common mode choke coil 101 has already been described in the first exemplary embodiment. That is, the common mode choke coil 101 includes the first coil element L1 and the second coil element L2 connected in series between the first port P1 and the second port P2, and the third coil element L3 and the fourth coil element L4 connected in series between the third port P3 and the fourth port P4. The first port P1 and the second port P2 are connected in series to a first transmission line that is one of lines included in a balanced line. The third port P3 and the fourth port P4 are connected in series to a second transmission line that is the other one of the lines included in the balanced line.

The ESD protection element ESD1 is connected between the second port P2 and a first ground port GND1. The ESD protection element ESD2 is connected between the fourth port P4 and a second ground port GND2.

For example, a feeding circuit 10 is connected between the first port P1 and the third port P3. For example, a digital signal circuit is connected between the second port P2 and the fourth port P4.

Figure 5:
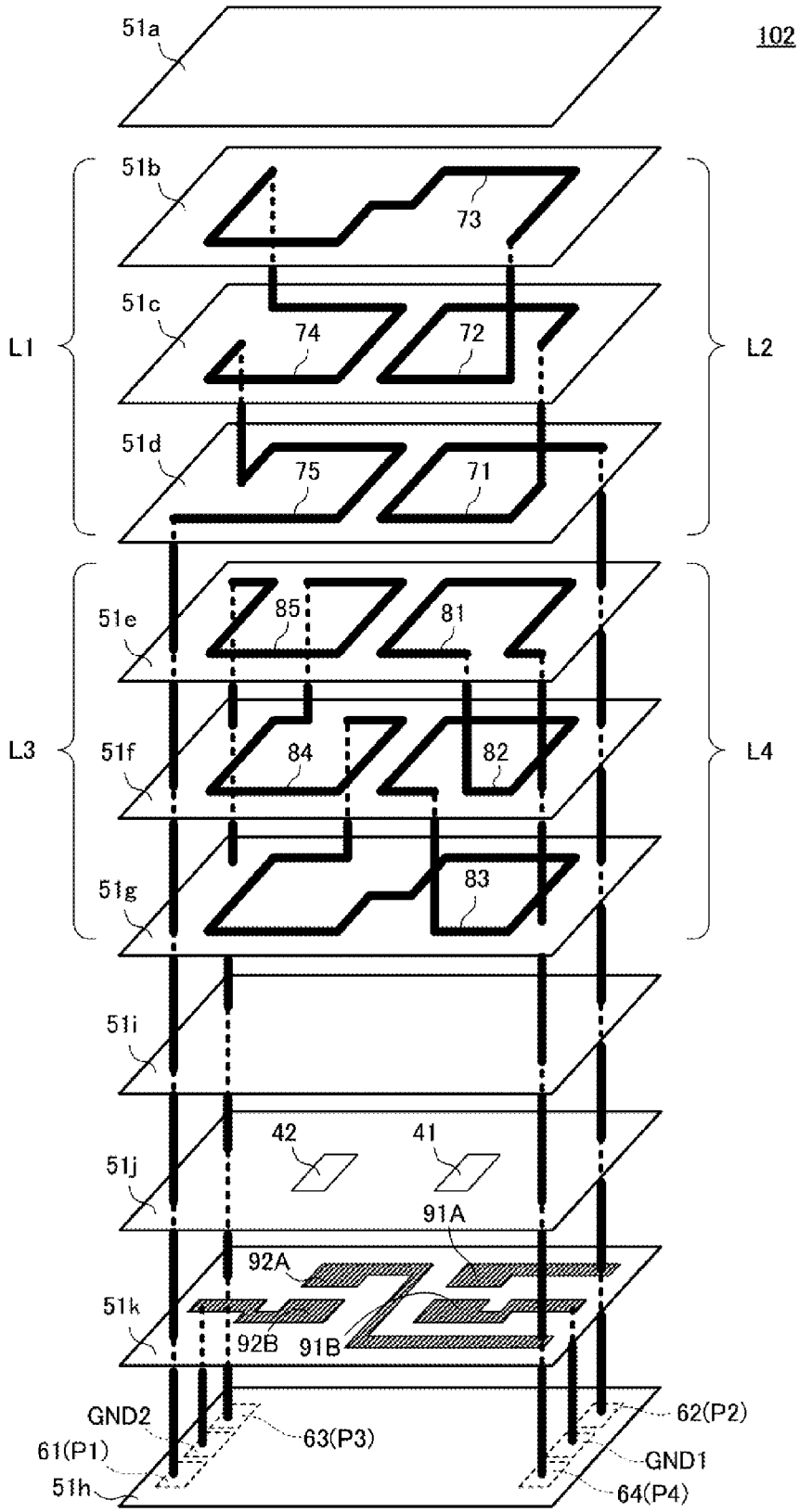
FIG. 5 is an exploded perspective view of the common mode choke coil according to the second exemplary embodiment having an ESD protection function.

FIG. 5 is an exploded perspective view of the common mode choke coil 102 according to the second exemplary embodiment having an ESD protection function.

As illustrated in FIG. 5, at the base substrate layers 51*b* to 51*g* and base substrate layers 51*k* and 51*h*, conductive patterns are formed. At the base substrate layer 51*b*, the conductive pattern 73 is formed. At the base substrate layer 51*c*, the conductive patterns 72 and 74 are formed. At the base substrate layer 51*d*, the conductive patterns 71 and 75 are formed. At the base substrate layer 51*e*, the conductive patterns 81 and 85 are formed. At the base substrate layer 51*f*, the conductive patterns 82 and 84 are formed. At the base substrate layer 51*g*, the conductive pattern 83 is formed. At the base substrate layer 51*k*, discharging electrodes 91A, 91B, 92A, and 92B are formed. On the undersurface of the base substrate layer 51*h*, the terminals 61, 62, 63, and 64, which correspond to the ports P1, P2, P3, and P4, respectively, are formed. At the base substrate layer 51*i*, no conductive pattern is formed. At the base substrate layer 51*j*, cavity portions 41 and 42 are formed. The discharging electrodes 91A and 91B at the base substrate layer 51*k* face each other in the cavity portion 41. The discharging electrodes 92A and 92B at the base substrate layer 51*k* face each other in the cavity portion 42. It is desired that discharge supporting powder and semiconductor powder be put between the pair of discharging electrodes. As a result, a discharge start voltage becomes low and stable.

Each line extending in the vertical direction in FIG. 5 is a via electrode, or via conductor, and connects conductive patterns via layers.

Referring to FIG. 5, the conductive pattern 71 to 75 form the coil elements L1 and L2, and the conductive patterns 81 to 85 form the coil elements L3 and L4.

When static electricity exceeding a voltage to be protected is applied from the second port P2 or the first port P1 to the first transmission line SL1, discharging occurs between the discharging electrodes 91A and 91B facing each other in the cavity portion 41. Subsequently, the static electricity applied to the first transmission line SL1 is shunted from the first ground port GND1 to the ground. When static electricity exceeding a voltage to be protected is applied from the fourth port P4 or the third port P3 to the second transmission line SL2, discharging occurs between the discharging electrodes 92A and 92B facing each other in the cavity portion 42. Subsequently, the static electricity applied to the second transmission line SL2 is shunted from the second ground port GND2 to the ground. Thus, the ESD protection elements operate.

Each conductive pattern can be made of a conductive material such as silver or copper. In order to form the base substrate layers 51*a* to 51*g*, a dielectric can be used. For example, the dielectric can be a glass-ceramic material, an epoxy resin material, a magnetic substance such as a ferrite ceramic material, or a resin material containing ferrite.

In a case where a multilayer ceramic substrate is used, paste that will disappear at the time of firing is used to form the cavity portions 41 and 42 and is fired under a reducing atmosphere. Ferrite ceramic cannot be fired under a reducing atmosphere. However, according to an exemplary embodiment, since a dielectric ceramic multilayer substrate is used, a problem caused by the use of ferrite ceramic does not arise.

According to an exemplary embodiment, two coil elements connected in series to each other and forming a closed magnetic circuit are provided at each of the first transmission line and the second transmission line. Accordingly, ESD protection elements and a choke coil can be integrated with a multilayer substrate including no magnetic layer and only dielectric layers.

In the example illustrated in FIGS. 4 and 5, two ground ports, the ground ports GND1 and GND2, are disposed. However, a common mode choke coil according to the present disclosure can include a single common ground port instead of separate ground ports.

Figure 6:
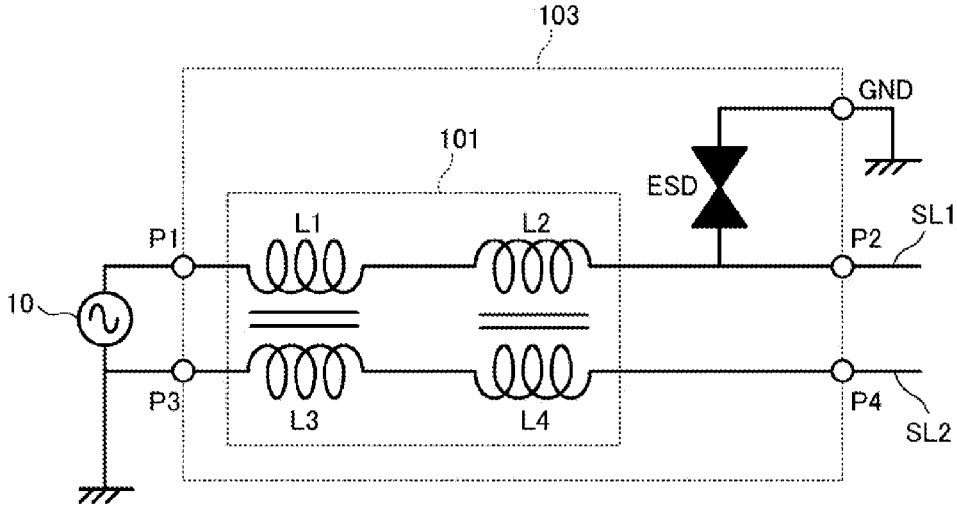
FIG. 6 is a circuit diagram of a common mode choke coil according to a third exemplary embodiment having an ESD protection function.

FIG. 6 is a circuit diagram of a common mode choke coil 103 according to a third exemplary embodiment, which has an ESD protection function. The common mode choke coil 103 having an ESD protection function includes the common mode choke coil 101 and an ESD protection element ESD. The difference between the second exemplary embodiment and the third exemplary embodiment is that the ESD protection element ESD is disposed at only the first transmission line SL1. The other configuration of the common mode choke coil 103 is the same as the configuration of the common mode choke coil 102 according to the second exemplary embodiment having an ESD protection function. As illustrated in FIG. 6, in a case where the second transmission line SL2 is connected to the ground, only a single ESD protection element may be provided.

Figure 7:
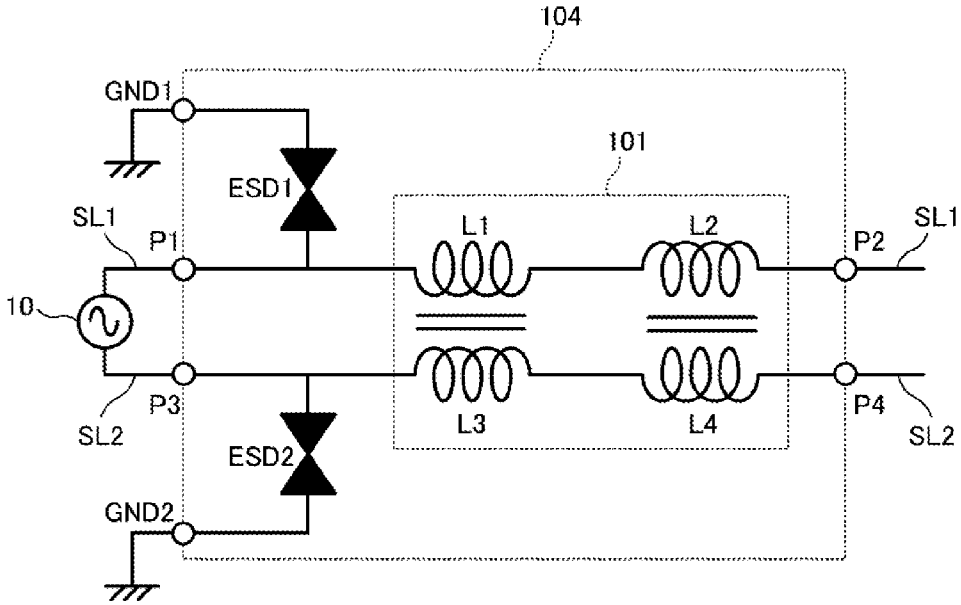
FIG. 7 is an equivalent circuit diagram of a common mode choke coil according to a fourth exemplary embodiment having an ESD protection function.

FIG. 7 is an equivalent circuit diagram of a common mode choke coil 104 according to a fourth exemplary embodiment having an ESD protection function. The common mode choke coil 104 having an ESD protection function includes the common mode choke coil 101 and the ESD protection elements ESD1 and ESD2. The difference between the second exemplary embodiment and the fourth exemplary embodiment is that the ESD protection elements ESD1 and ESD2 are disposed on the side of the first port P1 and the third port P3.

When static electricity exceeding a voltage to be protected is applied to the first port P1, the ESD protection element ESD1 including the above-described discharging electrodes and a discharging auxiliary electrode discharges (conducts) and the impedance thereof becomes low. As a result, the static electricity applied to the first port P1 is shunted to the ground via the ESD protection element ESD1. When static electricity exceeding a voltage to be protected is applied to the third port P3, the ESD protection element ESD2 conducts and the impedance thereof becomes low. As a result, the static electricity applied to the third port P3 is shunted to the ground via the ESD protection element ESD2.

In a case where the ESD protection elements ESD1 and ESD2 have a configuration with which discharging between discharging electrodes lets surge energy escape, it is desired that the ESD protection elements ESD1 and ESD2 be disposed on the static electricity enter side as illustrated in FIG. 7. In particular, even in a case where a circuit connected to the ports P2 and P4 has a low input impedance, a high-frequency surge such as ESD is reflected by the common mode choke coil 101 having a high impedance with respect to the surge, a high voltage is applied to the ESD protection elements ESD1 and ESD2, and the ESD protection elements ESD1 and ESD2 start discharging after quickly reaching a discharge voltage. Accordingly, the surge is prevented from entering the circuit connected to the ports P2 and P4 with more certainty.

In a case where each ESD protection element is formed of a varistor (e.g., a semiconductor ceramic having a nonlinear resistance characteristic), it is desired that the ESD protection element be disposed at a stage subsequent to the common mode choke coil (i.e., on the side of the ports P2 and P4) as illustrated in FIG. 4. As a result, a voltage applied to the ESD protection element (varistor) relatively slowly changes, and the ESD protection element (varistor) can be protected from permanent breakdown.

In the examples illustrated in FIGS. 3 and 5, each coil element is formed of a layered coil pattern, but each coil may be formed of a flat coil pattern.

Although not shown, the number of coil elements on each transmission line is not limited to two, and may be three or more. For example, the first coil element L1 may include two coil elements L1*a* and L1*b*, and the second coil element L2 may include two coil elements L2*a* and L2*b*. The third coil element L3 may be sandwiched between the two coil elements L1*a* and L1*b*, and the fourth coil element L4 may be sandwiched between the two coil elements L2*a* and L2*b*. In this case, the coil element L3 and the coil elements L1*a* and L1*b* are more tightly coupled, and the coil element L4 and the coil elements L2*a* and L2*b* are more tightly coupled. As a result, an inductance with respect to a common mode current can be increased, and the leakage of a magnetic field can be reduced.

The number of turns of each coil is not limited to the numbers in drawings illustrating the configurations of laminates according to the above-described exemplary embodiments.

According to exemplary embodiments disclosed herein, because two coil elements connected in series to each of a first transmission line and a second transmission line included in a balanced line form a closed magnetic circuit, effective magnetic confinement can be achieved with these closed magnetic circuits. Accordingly, the degree of coupling between two coil elements connected to the first transmission line and the degree of coupling between two coil elements connected to the second transmission line are increased. It is therefore possible to obtain a common mode choke coil capable of effectively removing common mode noise and a high-frequency component including the common mode choke coil.

Because a closed magnetic circuit formed by a plurality of coil elements is used, a magnetic body does not necessarily have to be used. By using, for example, a dielectric body having a relatively low frequency dependence, it is possible to obtain a common mode choke coil operable in a wide frequency band and a high-frequency component including the common mode choke coil.

In addition, it is possible to obtain a common mode choke coil that includes an ESD protection element in a multilayer substrate formed of not magnetic layers but only dielectric layers and a high-frequency component including the common mode choke coil.

While exemplary embodiments have been described above, it is to be understood that variations and modifications will be apparent to those skilled in the art without departing from the scope and spirit of the disclosure.

What is claimed is:

1. A common mode choke coil comprising:

a first transmission line;

a second transmission line paired with the first transmission line;

a first coil element connected in series to the first transmission line;

a second coil element connected in series to the first transmission line;

a third coil element connected in series to the second transmission line and coupled to the first coil element; and a fourth coil element connected in series to the second transmission line and coupled to the second coil element, and wherein winding directions and connection directions of the first coil element, the second coil element, the third coil element, and the fourth coil element are determined such that, with normal mode current flow through the first and second transmission lines, a first closed magnetic circuit forms in which a magnetic flux passing through the first coil element and the second coil element forms a closed loop and a second closed magnetic circuit forms in which a magnetic flux passing through the third coil element and the fourth coil element forms a closed loop, and, with common mode current flow through the first and second transmission lines, a third closed magnetic circuit forms in which a magnetic flux passing through the first coil element, the second coil element, the third coil element, and the fourth coil element forms a closed loop.

2. The common mode choke coil according to claim 1, wherein the first coil element and the second coil element are disposed so that winding axes of the first coil element and the second coil element are substantially parallel to each other, and wherein the third coil element and the fourth coil element are disposed so that winding axes of the third coil element and the fourth coil element are substantially parallel to each other.

3. The common mode choke coil according to claim 1, wherein the first coil element and the third coil element are disposed adjacent to each other in a direction of the same winding axis shared by the first coil element and the third coil element, and wherein the second coil element and the fourth coil element are disposed adjacent to each other in a direction of the same winding axis shared by the second coil element and the fourth coil element.

4. The common mode choke coil according to claim 2, wherein the first coil element and the third coil element are disposed adjacent to each other in a direction of the same winding axis shared by the first coil element and the third coil element, and wherein the second coil element and the fourth coil element are disposed adjacent to each other in a direction of the same winding axis shared by the second coil element and the fourth coil element.

5. The common mode choke coil according to claim 1, wherein the first coil element, the second coil element, the third coil element, and the fourth coil element are formed of conductive patterns and via conductors for connecting layers which are placed in a laminate obtained by laminating a plurality of dielectric layers.

6. The common mode choke coil according to claim 5, wherein a magnetic layer is placed between a conductive pattern forming the first coil element and the second coil element and a conductive pattern forming the third coil element and the fourth coil element.

7. The common mode choke coil according to claim 5, wherein an ESD protection element is placed in the laminate and is connected to the first transmission line or the second transmission line.

8. The common mode choke coil according to claim 6, wherein an ESD protection element is placed in the laminate and is connected to the first transmission line or the second transmission line.

9. A high-frequency component comprising a common mode choke coil that includes:

a first transmission line;

a second transmission line paired with the first transmission line;

a first coil element connected in series to the first transmission line;

a second coil element connected in series to the first transmission line;

a third coil element connected in series to the second transmission line and coupled to the first coil element; and a fourth coil element connected in series to the second transmission line and coupled to the second coil element, and wherein winding directions and connection directions of the first coil element, the second coil element, the third coil element, and the fourth coil element are determined such that, with normal mode current flow through the first and second transmission lines, a first closed magnetic circuit forms in which a magnetic flux passing through the first coil element and the second coil element forms a closed loop and a second closed magnetic circuit forms in which a magnetic flux passing through the third coil element and the fourth coil element forms a closed loop, and, with common mode current flow through the first and second transmission lines, a third closed magnetic circuit forms in which a magnetic flux passing through the first coil element, the second coil element, the third coil element, and the fourth coil element forms a closed loop.

* * * * *